US006959571B2

(12) United States Patent
Yamamoto et al.

(10) Patent No.: US 6,959,571 B2
(45) Date of Patent: Nov. 1, 2005

(54) ROLLING MILL AND METHOD FOR OPERATING SAME

(75) Inventors: Mikio Yamamoto, Hiroshima (JP); Atsushi Higashio, Hiroshima (JP); Hideaki Furumoto, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 142 days.

(21) Appl. No.: 10/192,641

(22) Filed: Jul. 11, 2002

(65) Prior Publication Data

US 2003/0024293 A1 Feb. 6, 2003

(30) Foreign Application Priority Data

Aug. 2, 2001 (JP) ..... 2001-234654

(51) Int. Cl.[7] ..... B21B 37/08
(52) U.S. Cl. ..... 72/8.8; 72/11.5; 72/12.5
(58) Field of Search ..... 72/7.5, 8.3, 8.8, 72/11.1, 11.5, 12.5, 10.4, 245

(56) References Cited

U.S. PATENT DOCUMENTS 3,124,982 A * 3/1964 Neumann ..... 72/8.8
5,634,360 A * 6/1997 Tazoe et al. ..... 72/12.5
6,354,128 B1 * 3/2002 Donini et al. ..... 72/237
6,510,721 B1 * 1/2003 Yamamoto et al. ..... 72/245

FOREIGN PATENT DOCUMENTS

| | | | | |
|---|---|---|---|---|
| EP | 1120172 A1 | | 8/2001 | |
| JP | 58167010 A | * | 10/1983 | ..... B21B/37/00 |
| JP | 59183915 A | * | 10/1984 | ..... B21B/37/00 |
| JP | 61209701 A | * | 9/1986 | ..... B21B/1/02 |
| JP | 11314107 A | * | 11/1999 | ..... B21B/31/02 |
| JP | 2000-254719 A | | 9/2000 | |
| JP | 2001-113308 A | | 4/2001 | |
| WO | WO 99/33587 | * | 7/1999 | ..... B21B/37/64 |

* cited by examiner

*Primary Examiner*—Lowell A. Larson
(74) *Attorney, Agent, or Firm*—Birch, Stewart, Kolasch & Birch, LLP

(57) ABSTRACT

Hydraulic cylinders are provided in a housing so as to be opposed to work rolls and backup rolls. Before a front end portion of a rollable material is engaged between the work rolls, the working oil pressure of the hydraulic cylinders is set at a high pressure value to make a pressing force on roll chocks high. After the rollable material is completely engaged between the work rolls, the working oil pressure of the hydraulic cylinders is set at a low pressure value to make the pressing force on the roll chocks low.

6 Claims, 6 Drawing Sheets

ROLLING MILL AND METHOD FOR OPERATING SAME

The entire disclosure of Japanese Patent Application No. 2001-234654 filed on Aug. 2, 2001 including specification, claims, drawings and summary is incorporated herein by reference in its entirety.

BACKGROUND OF THE INVENTION

1. Field of the Invention

This invention relates to a rolling mill for rolling a strip material or the like, which passes through upper and lower rolling rolls, to a predetermined thickness, and a method for operating the rolling mill.

2. Description of Related Art

In an ordinary rolling mill, upper and lower work rolls are rotatably supported inside a housing via work roll chocks, and the upper and lower work rolls are opposed to each other. Upper and lower backup rolls are also rotatably supported inside the housing via backup roll chocks, and the upper and lower backup rolls are opposed to the upper and lower work rolls, respectively. A screw down device for imposing a rolling load on the upper work roll via the upper backup roll is provided in an upper portion of the housing.

Thus, a strip is fed from an entry side of the housing, and passed between the lower work roll and the upper work roll given a predetermined load by the screw down device via the backup roll, whereby the strip is rolled to a predetermined thickness. The rolled strip is delivered from a delivery side of the housing and supplied to a subsequent step.

In the foregoing rolling mill, hysteresis during vertical control of the work rolls and backup rolls in the housing needs to be minimized in a rolling condition under a screw down force to control the thickness of a rolled plate at high accuracy. For this purpose, gaps are formed between the work roll chocks and backup roll chocks and the housing. Thus, even though deformation in an inward narrowing amount is caused to the housing under the screw down load during rolling, gaps are present between the roll chocks and the housing, so that the horizontal dynamic stiffness of the rolling mill may be low. If rolling is performed with a high rolling force and a high percentage reduction in the thickness of the strip while the horizontal dynamic stiffness of the rolling mill is low, great vibrations probably attributed to, for example, friction between the strip being rolled and the work rolls (hereinafter referred to as mill vibrations) occur in the housing or the work rolls, thereby impeding high efficiency rolling.

The applicant of the present application filed Japanese Patent Application No. 2000-187163 (Japanese Unexamined Patent Publication No. 2001-113308) as a solution to the above-described problems. The invention of this application has upper and lower work rolls as a pair and upper and lower backup rolls as a pair rotatably supported in a housing via roll chocks; a screw down device provided in an upper portion of the housing for imposing a predetermined pressure on the upper work roll; and hydraulic cylinder mechanisms provided on an entry side and a delivery side of the housing, the hydraulic cylinder mechanisms being capable of thrusting the roll chocks in a horizontal direction. According to this configuration, the hydraulic cylinder mechanisms are actuated during rolling to eliminate the gaps between the roll chocks and the housing, thereby improving the horizontal dynamic stiffness. As a result, mill vibrations are suppressed, permitting high efficiency rolling.

Truly, mill vibrations can be suppressed by eliminating the gaps between the roll chocks and the housing through actuation of the hydraulic cylinder mechanisms during rolling. Further studies and experiments conducted by the applicant, however, showed that the optimal pressing force exerted on the roll chocks by the hydraulic cylinder mechanisms varied according to the rolling condition.

SUMMARY OF THE INVENTION

The present invention has been accomplished to solve the above problems. Its object is to provide a rolling mill and a method for operating the rolling mill, the rolling mill being capable of increasing the accuracy of the plate thickness of a rolled material by suppressing an impact force which is generated when a material to be rolled (hereinafter referred to as a rollable material) is engaged between rolling rolls.

As an aspect of the present invention, there is provided a rolling mill comprising, a housing, upper and lower rolling rolls rotatably supported by the housing via roll chocks, screw down means provided in an upper portion of the housing and adapted to apply a predetermined pressure to the rolling roll, pressing means for thrusting the roll chocks along a transport direction of a rollable material to press the roll chocks against the housing, end portion detecting means for detecting an end portion of the rollable material which is traveling, rolling force detecting means for detecting a rolling force by the rolling rolls, and control means which, based on results of detection by the end portion detecting means, sets a thrusting force by the pressing means at a high value before engagement of the rollable material between the rolling rolls, and which, based on results of detection by the rolling force detecting means, sets the thrusting force at a low value after engagement of the rollable material.

Thus, the impact force generated when the front end portion of the rollable material is engaged between the rolling rolls can be alleviated, so that the accuracy of the plate thickness can be increased. Moreover, mill vibrations occurring in the housing or rolling rolls during rolling can be prevented, so that the passage of the plate is improved and high efficiency rolling can be achieved.

In the rolling mill, based on the results of detection by the end portion detecting means, the control means may set the thrusting force by the pressing means at a high value before passage of the rear end of the rollable material from between the rolling rolls. Thus, buckling or bending or a snaking motion caused when the rear end portion of the rollable material departs from the rolling rolls can be suppressed.

In the rolling mill, based on the results of detection by the rolling force detecting means, the control means may set the thrusting force by the pressing means at a low value after passage of the rear end of the rollable material from between the rolling rolls. Thus, resistance force can be decreased when setting up the rolling mill again for a next rollable material, so that the accuracy of setup can be increased and the lives of the members can be prolonged.

In the rolling mill, when a plurality of the rolling mills are arranged in a row, the rolling mill in a succeeding stage may use the rolling force detecting means, mounted on the rolling mill in a preceding stage, as the end portion detecting means. Thus, the end portion of the rollable material can be detected reliably to increase the accuracy of control.

According to another aspect of the present invention, there is provided a method for operating a rolling mill comprising, a housing, upper and lower rolling rolls rotatably supported by the housing via roll chocks, screw down means provided in an upper portion of the housing for applying a predetermined pressure to the rolling roll, and pressing means for thrusting the roll chocks along a transport direction of a rollable material to press the roll chocks against the housing, the method comprising setting a thrusting force by the pressing means at a high value when the rollable material is engaged between the rolling rolls.

Thus, the impact force generated when the front end portion of the rollable material is engaged between the rolling rolls can be alleviated, so that the accuracy of the plate thickness can be increased.

The method for operating a rolling mill may further comprising, setting the thrusting force by the pressing means at a low value after engagement of the rollable material between the rolling rolls. Thus, mill vibrations occurring in the housing or rolling rolls during rolling can be prevented. Moreover, the thrusting force more than that necessary during rolling can be excluded, and resistance to the vertical movement of the roll can be minimized. Consequently, the plate thickness accuracy of the rolled material can be ensured.

The method for operating a rolling mill may further comprise, setting the thrusting force by the pressing means at a high value before passage of a rear end of the rollable material from between the rolling rolls. Thus, buckling or bending or a snaking motion caused when the rear end portion of the rollable material departs from the rolling rolls can be suppressed.

The method for operating a rolling mill may further comprise, setting the thrusting force by the pressing means at a low value after passage of the rear end of the rollable material from between the rolling rolls. Thus, resistance force can be decreased when setting up the rolling mill again for a next rollable material, so that the accuracy of setup can be increased and the lives of the members can be prolonged.

The method for operating a rolling mill may further comprise, setting the thrusting force by the pressing means at a high value since before passage of a rear end of the rollable material from between the rolling rolls until completion of engagement of a next rollable material between the rolling rolls. Thus, complicated control becomes unnecessary, and the durability of various component parts can be increased.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Embodiments of the present invention will now be described in detail with reference to the accompanying drawings, which in no way limit the invention.

First Embodiment

Figure 1:
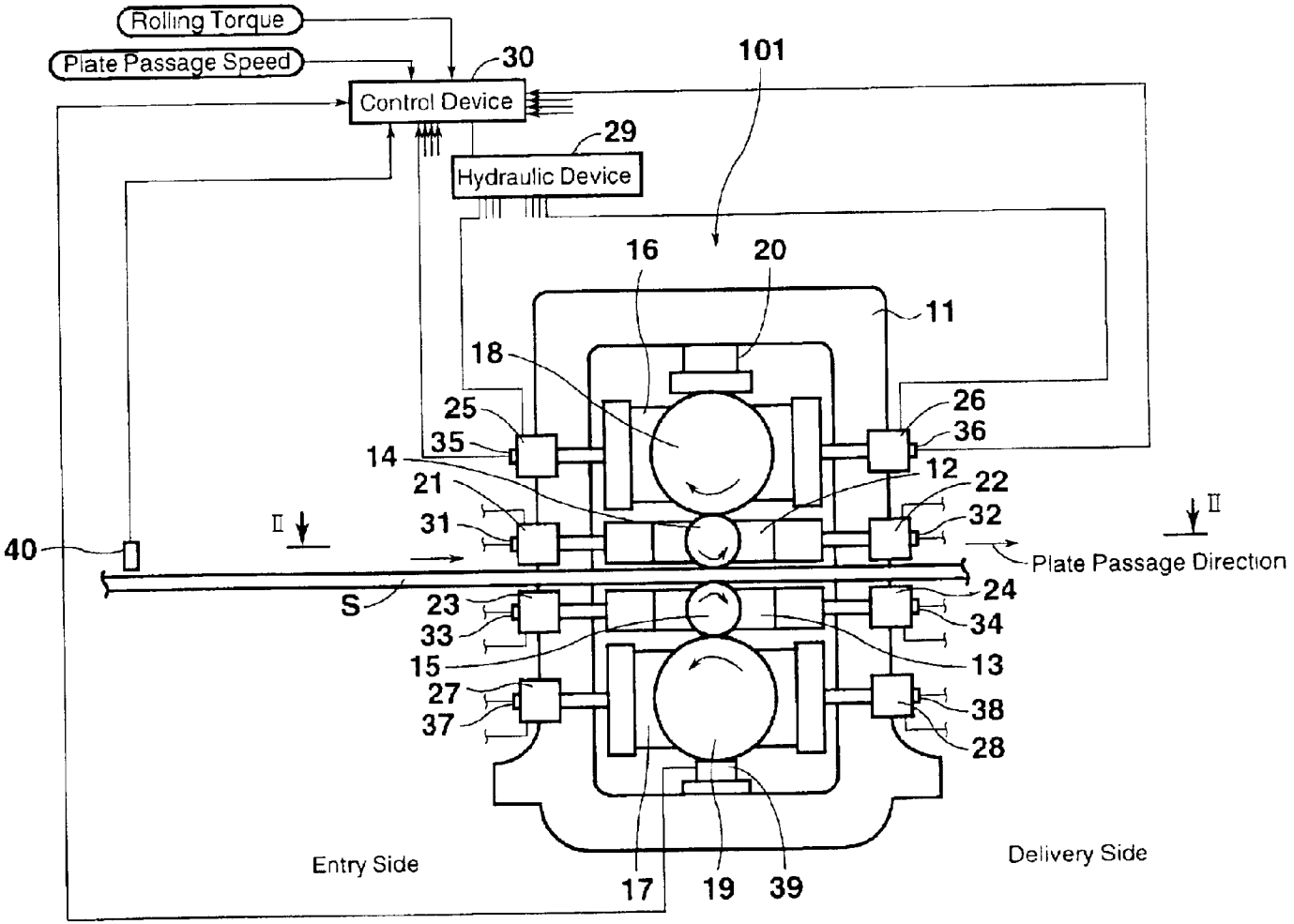
FIG. 1 is a schematic side view of a rolling mill according to a first embodiment of the present invention.
Figure 2:
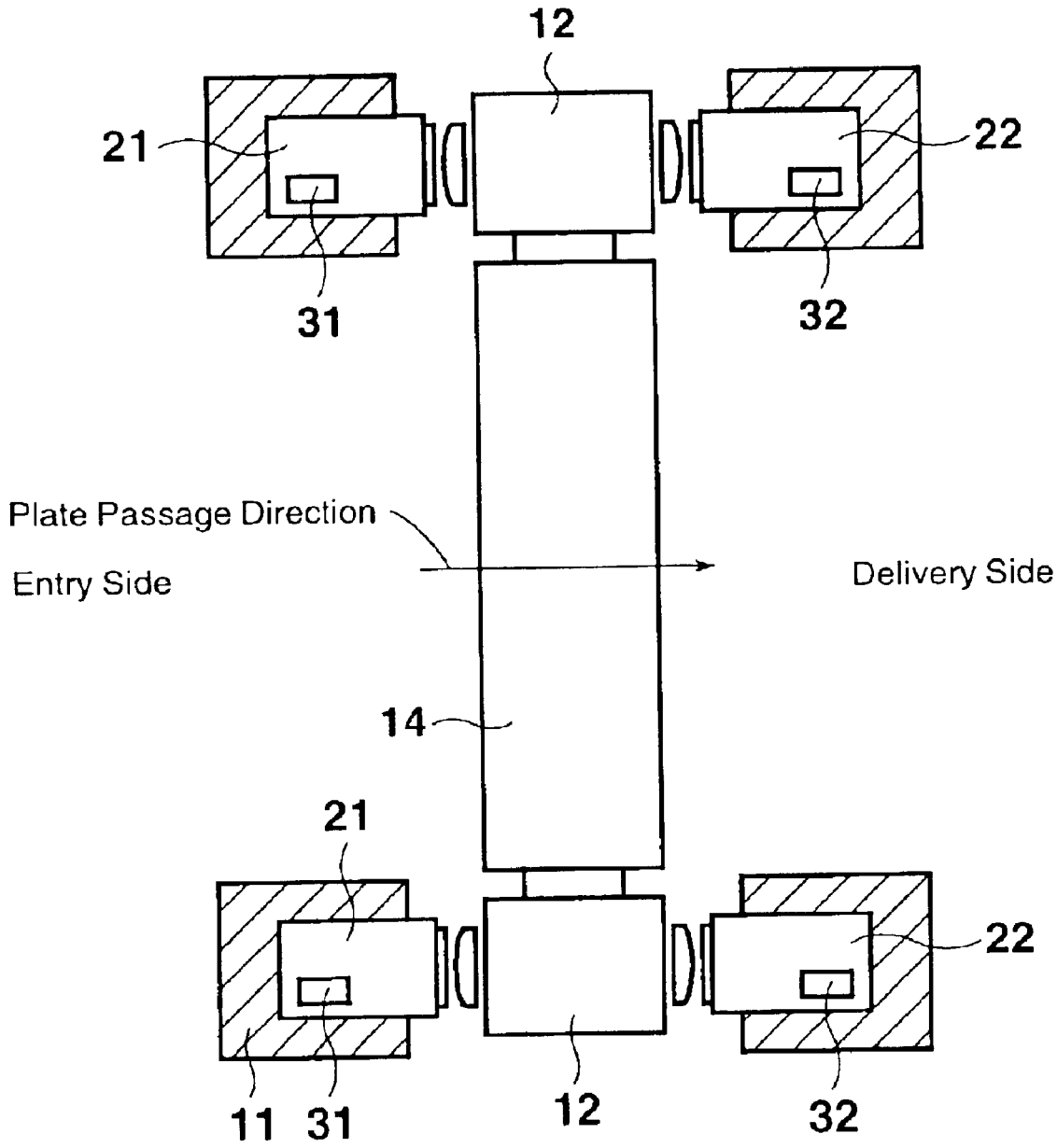
FIG. 2 is a sectional view taken along line II—II of FIG. 1.

In a rolling mill 101 according to the first embodiment, as shown in FIGS. 1 and 2, upper and lower work roll chocks 12 and 13 as a pair are supported in a housing 11. Shaft portions of upper and lower work rolls 14 and 15 as a pair are rotatably supported by the upper and lower work roll chocks 12 and 13, respectively, and the upper work roll 14 and the lower work roll 15 are opposed to each other. Upper and lower backup roll chocks 16 and 17 as a pair are supported above and below the upper and lower work roll chocks 12 and 13. Shaft portions of upper and lower backup rolls 18 and 19 as a pair are rotatably supported by the upper and lower backup roll chocks 16 and 17, respectively. The upper backup roll 18 and the upper work roll 14 are opposed to each other, while the lower backup roll 19 and the lower work roll 15 are opposed to each other. A screw down device 20 for imposing a rolling load on the upper work roll 14 via the upper backup roll 18 is provided in an upper portion of the housing 11.

Hydraulic cylinders (pressing means) 21 and 22 are mounted on an entry side and a delivery side of the housing 11 so as to be opposed to the upper work roll chock 12. The hydraulic cylinders 21 and 22 can be pressed against the housing 11 by thrusting the upper work roll chock 12 from upstream and downstream sides via liners along a transport direction. Hydraulic cylinders (pressing means) 23 and 24 are mounted on the entry side and the delivery side of the housing 11 so as to be opposed to the lower work roll chock 13. The hydraulic cylinders 23 and 24 can be pressed against the housing 11 by thrusting the lower work roll chock 13 from upstream and downstream sides via liners along the transport direction. Hydraulic cylinders (pressing means) 25 and 26 are mounted on the entry side and the delivery side of the housing 11 so as to be opposed to the upper backup roll chock 16. The hydraulic cylinders 25 and 26 can be pressed against the housing 11 by thrusting the upper backup roll chock 16 from upstream and downstream sides via liners along the transport direction. Hydraulic cylinders (pressing means) 27 and 28 are mounted on the entry side and the delivery side of the housing 11 so as to be opposed to the lower backup roll chock 17. The hydraulic cylinders 27 and 28 can be pressed against the housing 11 by thrusting the lower backup roll chock 17 from upstream and downstream sides via liners along the transport direction.

The hydraulic cylinders 21 to 28 are composed of cylinders fixed to the housing 11, pistons movable within the cylinders, and rods extending outward from the pistons and having front end portions connected to the roll chocks 12, 13, 16, 17. The hydraulic cylinders 21 to 28 are connected to a hydraulic device 29 having a hydraulic tank, a hydraulic pump, etc., and the hydraulic device 29 is connected to a control device 30. Thus, the control device 30 controls the hydraulic device 29 to feed and withdraw an oil pressure to and from the hydraulic cylinders 21 to 28, thereby controlling their operation. Oil pressure sensors 31 to 38 for detecting the working oil pressures are mounted on the hydraulic cylinders 21 to 28. Based on the results of detection by these oil pressure sensors 31 to 38, the control device 30 exercises feedback control over the hydraulic device 29.

A load cell 39, as rolling force detection means for detecting a rolling force exerted on a rollable material S by the work rolls 14, 15, is provided in a lower portion of the housing 11. The load cell 39 outputs the results of detection to the control device 30. Moreover, an end portion detection sensor 40 for detecting a front end portion and a rear end portion of the rollable material S being transported is disposed on the entry side of the rolling mill 101.

Figure 3:
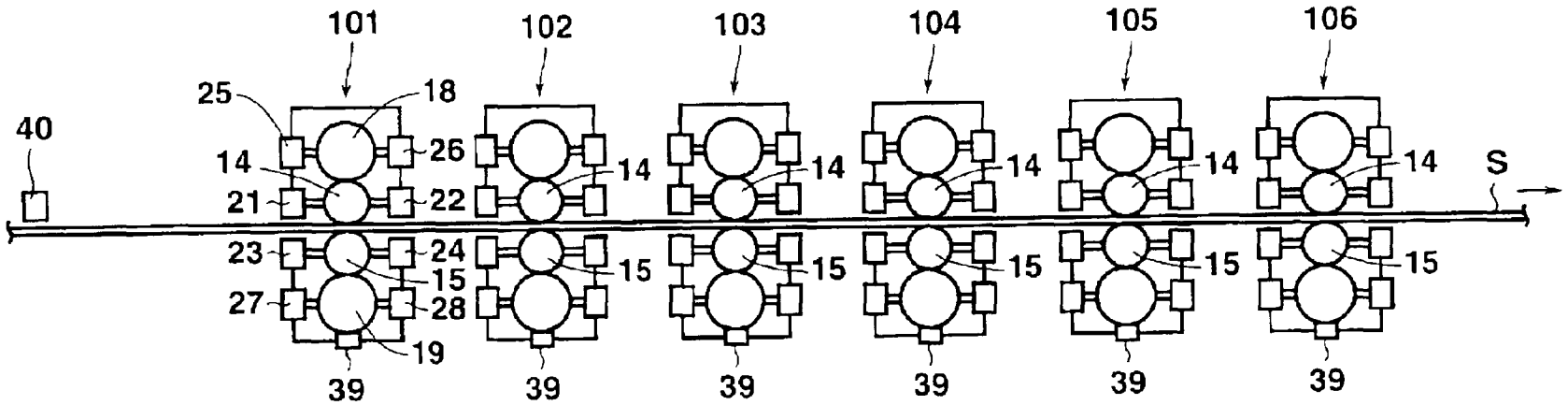
FIG. 3 is a schematic view of finish rolling equipment.

A plurality of the thus configured rolling mills 101 of the present embodiment are arranged in a row to constitute finish rolling equipment. As shown in FIG. 3, a plurality of finish rolling mills, i.e., first to sixth finish rolling mills 101, 102, 103, 104, 105 and 106, are provided in a row along a transport direction of the rollable material S and located downstream from a rough rolling mill (not shown) in the transport direction. The finish rolling mills 101, 102, 103, 104, 105 and 106 have practically the same structure as the aforementioned rolling mill 101. That is, each of the finish rolling mills has upper and lower work rolls 14 and 15 as a pair, upper and lower backup rolls 18 and 19 as a pair, hydraulic cylinders 21 to 28, oil pressure sensors 31 to 38, and a load cell 39. The results of detection are outputted to a control device 30.

In a method for operating the rolling mill according to the present embodiment, the control device 30 controls the hydraulic device 29 in the following manner: Before the front end portion of the rollable material S is engaged between the work rolls 14 and 15, the pressing force on the roll chocks 12, 13, 16, 17 by the hydraulic cylinders 21 to 28 is set at a high value. After the rollable material S is engaged between the work rolls 14 and 15, this pressing force is set at a low value.

The method of controlling the hydraulic device 29 by the control device 30 will be described in detail based on a time chart in FIG. 4 which illustrates the working oil pressure of the hydraulic cylinders.

Figure 4:
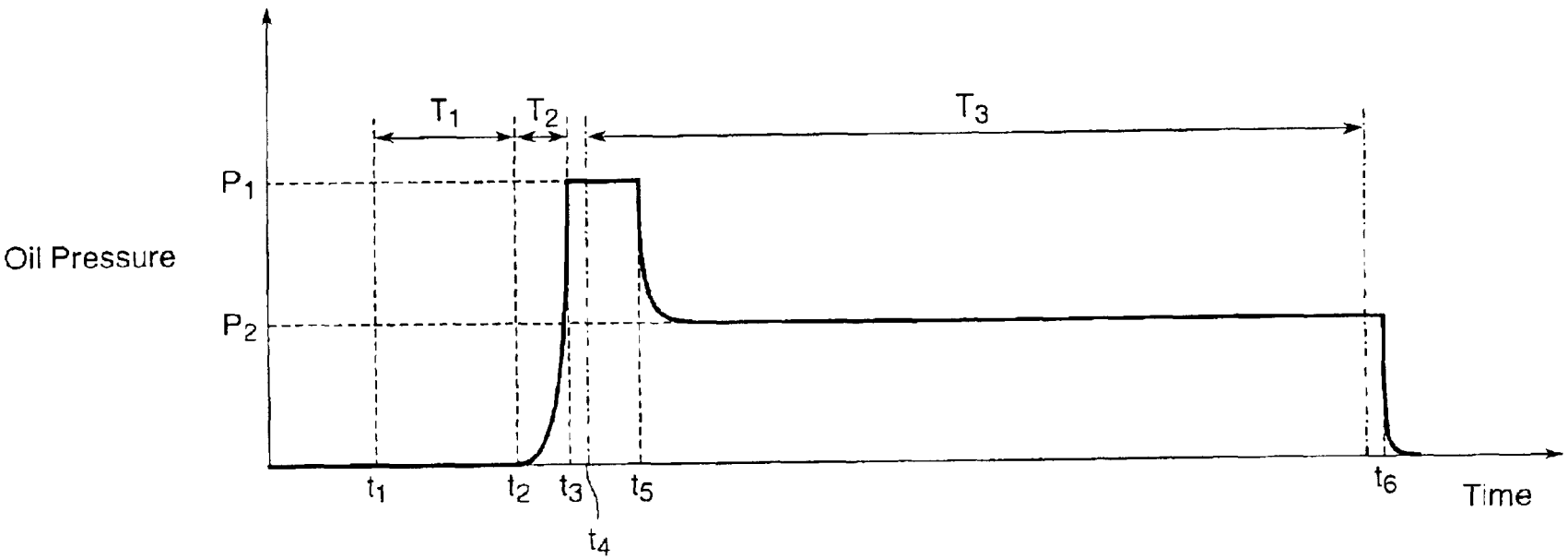
FIG. 4 is a time chart showing the working oil pressure of hydraulic cylinders in a method for operating the rolling mill according to the first embodiment of the present invention.

As shown in FIGS. 1, 3 and 4, when the rollable material S is transported from the rough rolling mill toward the finish rolling equipment and comes just in front of the rolling mill 101, the end portion detection sensor 40 detects the front end portion of the rollable material S and outputs the results of detection to the control device 30. The control device 30 controls the hydraulic device 29 at a time $t_2$, a predetermined time $T_1$ after a time $t_1$ when the end portion detection sensor 40 detects the front end portion of the rollable material S, thereby raising the working oil pressure of the hydraulic cylinders 21 to 28. In this case, it is necessary to consider the transport speed of the rollable material S, and an oil pressure supply delay time $T_2$ for supply of the oil pressure from the hydraulic device 29 to the hydraulic cylinders 21 to 28. Based on these parameters, the predetermined time $T_1$ needs to be set such that the working oil pressure of the hydraulic cylinders 21 to 28 reaches a predetermined high pressure value $P_1$ before the front end portion of the rollable material S is engaged between the work rolls 14 and 15. The position of mounting of the end portion detection sensor 40 may be set such that the time $t_1$ and the time $t_2$ are the same, namely, the predetermined time $T_1=0$.

At a time $t_3$, the working oil pressure of the hydraulic cylinders 21 to 28 is the high pressure value $P_1$. Then, at a time $t_4$, the front end portion of the rollable material S is engaged between the work rolls 14 and 15. At this time, the work rolls 14 and 15 undergo a load upon contact with the front end portion of the rollable material S. Thus, a great force moving the work rolls 14 and 15 toward the entry side acts on the work rolls 14, 15, and their rotational speed lowers. However, the roll chocks 12, 13 supporting the work rolls 14, 15 are pressed against the housing 11 by the hydraulic cylinders 21, 23 at the working oil pressure $P_1$. Thus, the moving force of the work rolls 14, 15 toward the entry side is abated. The backup rolls 18, 19, on the other hand, undergo a great force heading toward the delivery side, because of the decrease in the rotational speed of the work rolls 14, 15. However, the roll chocks 16, 17 supporting the backup rolls 18, 19 are pressed against the housing 11 by the hydraulic cylinders 26, 28 at the working oil pressure $P_1$. Thus, the moving force of the backup rolls 18, 19 toward the delivery side is abated.

Then, a speed control device (not shown) increases a roll drive force to return the rotational speed of the work rolls 14, 15 to a predetermined rotational speed, because their rotational speed has decreased. At this time, a great force acts on the work rolls 14, 15 toward the delivery side, and the backup rolls 18, 19 toward the entry side. However, the rolls 14, 15, 18, 19 are pressed against the housing 11 by the hydraulic cylinders 22, 24, 25, 27 at the working oil pressure $P_1$. Thus, the moving force of the work rolls 14, 15 and backup rolls 18, 19 held is abated.

When the front end portion of the rollable material S is engaged between the work rolls 14 and 15, a reaction force against rolling changes (increases). Based on this increase in the reaction force against rolling, the load cell 39 detects the engagement of the rollable material S between the work rolls 14 and 15. After the rollable material S is completely engaged between the work rolls 14 and 15 and its impact force abates, the rotational speeds of the work rolls 14, 15 and backup rolls 18, 19 are corrected to predetermined speeds. On this occasion, the control device 30 controls the hydraulic device 29 at a time $t_5$ to lower the working oil pressure of the hydraulic cylinders 21 to 28 and keep it at a predetermined low pressure value $P_2$.

During such rolling of the rollable material S, an inward narrowing deformation amount occurs in the housing 11 in response to the screw down load. However, the thrusting force has been exerted on the housing 11 by actuating the hydraulic cylinders 21 to 28, whereby the deformation amount of the housing 11 is decreased. Thus, even if the roll chocks 12, 13, 16, 17 are displaced, no gaps occur between the roll chocks and the housing 11. As a result, the horizontal dynamic stiffness of the rolling mill is kept high. Even when rolling is performed in this state with a high rolling force and a high percentage reduction in the plate thickness, great mill vibrations probably attributed to, for example, friction between the rollable material S and the work rolls 14, 15 do not occur in the housing 11 or the work rolls 14, 15, thus permitting high efficiency rolling.

In the first rolling mill 101, the control device 30 controls the working oil pressure of the hydraulic cylinders 21 to 28 described above. The second to sixth finish rolling mills 102 to 106 also perform the same control. However, there are no end portion detection sensors just in front of the second to sixth finish rolling mills 102 to 106. Furthermore, the transport speed of the rollable material S differs according to the distances between the respective rolling mills. Hence, control using a prediction of the front end portion of the rollable material S, based on the results of detection by the end portion detector sensor 40, would result in insufficient accuracy. The second to sixth finish rolling mills 102 to 106, therefore, use the load cells 39, which are mounted on the corresponding rolling mills 101 to 105 in the preceding stages, as end portion detection sensors, and determine the position of the front end portion of the rollable material S based on increases in the reaction forces against rolling.

In the second finish rolling mill 102, for example, when the load cell 39 of the first finish rolling mill 101 detects an increase in the reaction force against rolling, the control device 30 determines that the front end portion of the rollable material S is located in the first finish rolling mill 101. The control device 30 controls the hydraulic device 29 to raise the working oil pressure of the hydraulic cylinders 21 to 28 of the second finish rolling mill 102, thereby bringing the working oil pressure of the hydraulic cylinders 21 to 28 to the high pressure value $P_1$ before the front end portion of the rollable material S is engaged between the work rolls 14 and 15.

The working oil pressure $P_1$ of the hydraulic cylinders 21, 23 at the time of the engagement of the rollable material S between the work rolls 14 and 15, and the working oil pressure $P_2$ of the hydraulic cylinders 21, 23 during rolling of the rollable material S by the work rolls 14 and 15 are set according to the rolling torque or the plate passage speed, and may be set, if desired, according to the thickness or width of the rollable material S.

Then, the rolling of the rollable material S by the first finish rolling mill 101 nears completion, and the end portion detection sensor 40 detects the rear end portion of the rollable material S. When the load cell 39 then detects a change (drop) in the reaction force against rolling, it is determined that the rear end portion of the rollable material S has left the first finish rolling mill 101. At a time $t_6$ when the rear end portion of the rollable material S is determined to have left the first finish rolling mill 101, the control device 30 controls the hydraulic device 29 to lower the working oil pressure of the hydraulic cylinders 21 to 28.

In the rolling mill of the present embodiment and the method for its operation, as described above, before the front end portion of the rollable material S is engaged between the work rolls 14 and 15, the working oil pressure of the hydraulic cylinders 21 to 28 is set at the high pressure value $P_1$, whereby the pressing force on the roll chocks 12, 13, 16, 17 is rendered high. After the rollable material S is completely engaged between the work rolls 14 and 15, the working oil pressure of the hydraulic cylinders 21 to 28 is set at the low pressure value $P_2$, whereby the pressing force on the roll chocks 12, 13, 16, 17 is rendered low.

Thus, the impact force generated when the front end portion of the rollable material S is engaged between the work rolls 14 and 15, namely, the force which moves the work rolls 14, 15 and backup rolls 18, 19 to an upstream or downstream side in the transport direction, can be alleviated by the hydraulic cylinders 21 to 28, so that the accuracy of the plate thickness can be increased. Moreover, mill vibrations occurring in the housing 11 or work rolls 14, 15 during rolling can be prevented, so that the passage of the plate is improved and high efficiency rolling can be achieved.

Second Embodiment

In a method for operating the rolling mill according to the second embodiment, the control device 30 controls the hydraulic device 29 such that before the rear end portion of the rollable material S passes between the work rolls 14 and 15, the pressing force on the roll chocks 12, 13, 16, 17 by the hydraulic cylinders 21 to 28 is set to be high, and after the rollable material S passes between the work rolls 14 and 15, this pressing force is set to be low.

Figure 5:
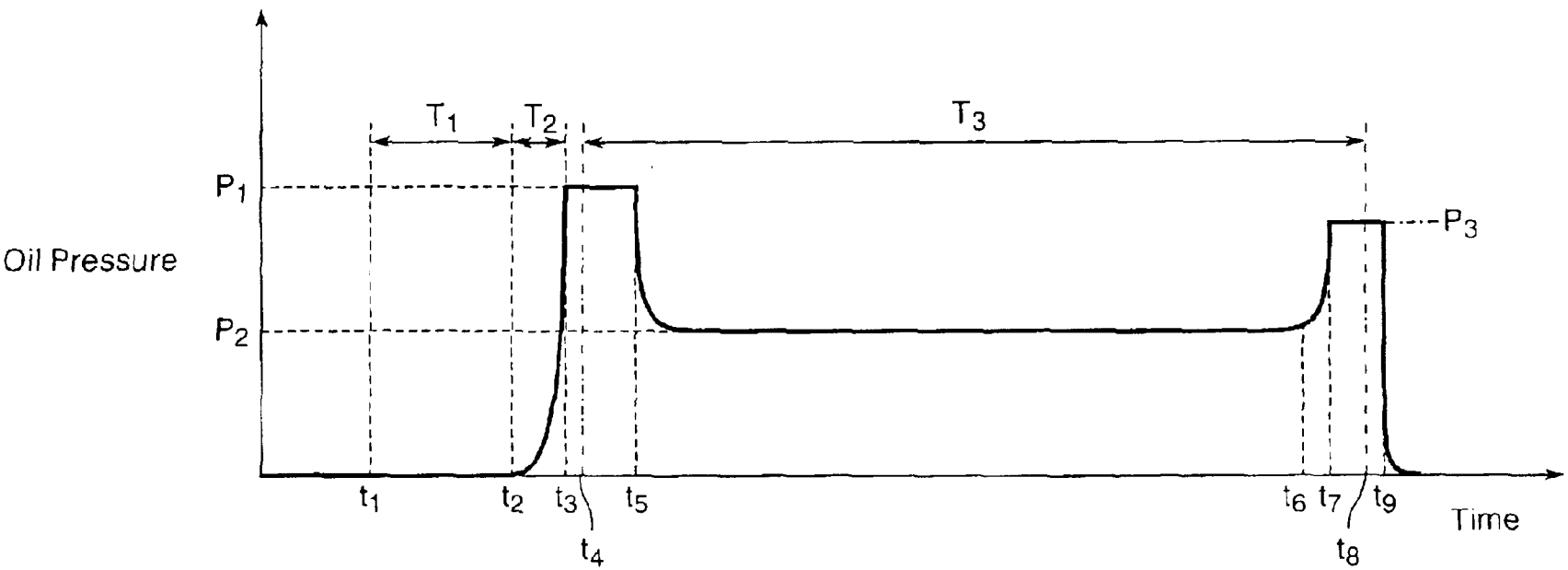
FIG. 5 is a time chart showing the working oil pressure of hydraulic cylinders in a method for operating a rolling mill according to a second embodiment of the present invention.

That is, as shown in FIGS. 3 and 5, the rolling of the rollable material S by the rolling mill 101 nears completion, and the end portion detection sensor 40 detects the rear end portion of the rollable material S. In this case, the control device 30 controls the hydraulic device 29 at a time $t_6$, a predetermined time after detection by the end portion detection sensor 40, thereby raising the working oil pressure of the hydraulic cylinders 21 to 28. At a time $t_7$, the working oil pressure of the hydraulic cylinders 21 to 28 reaches a high pressure value $P_3$ ($P_1>P_3$). At a time $t_8$, the rear end portion of the rollable material S comes outward from between the work rolls 14 and 15. At this time, the rear end portion of the rollable material S may be held so insufficiently that buckling or bending or a snaking motion of the plate is prone to occur. However, the rear end portion of the rollable material S is reliably held under the working oil pressure $P_3$ of the hydraulic cylinders 21 to 28, so that the rollable material S is properly transported. When the load cell 39 detects a decrease in the reaction force against rolling, it is determined that the rear end portion of the rollable material S has left the rolling mill 101. At a time $t_9$, the control device 30 controls the hydraulic device 29 to lower the working oil pressure of the hydraulic cylinders 21 to 28.

In the rolling mill of the present embodiment and the method for its operation, as described above, before the rear end portion of the rollable material S leaves the work rolls 14 and 15, the working oil pressure of the hydraulic cylinders 21 to 28 is set at the high pressure value $P_3$, whereby the pressing force on the roll chocks 12, 13, 16, 17 is rendered high. After the rollable material S completely leaves the work rolls 14 and 15, the working oil pressure of the hydraulic cylinders 21 to 28 is lowered. Thus, buckling or bending or a snaking motion caused when the rear end portion of the rollable material S disengages from the work rolls 14 and 15 can be suppressed, and the accuracy of the plate thickness can be increased.

As in the First Embodiment, the second to sixth finish rolling mills 102 to 106 use the load cells 39, which are mounted on the corresponding rolling mills 101 to 105 in the preceding stages, as end portion detection sensors, and determine the position of the front end portion of the rollable material S based on increases in the reaction forces against rolling.

Third Embodiment

In a method for operating the rolling mill according to the third embodiment, the control device 30 controls the hydraulic device 29 such that before the rear end portion of the rollable material S passes between the work rolls 14 and 15, the pressing force on the roll chocks 12, 13, 16, 17 by the hydraulic cylinders 21 to 28 is set to be high, and after this rollable material S passes between the work rolls 14 and 15 and a front end portion of a succeeding rollable material S is completely engaged between the work rolls 14 and 15, this pressing force is set to be low.

Figure 6:
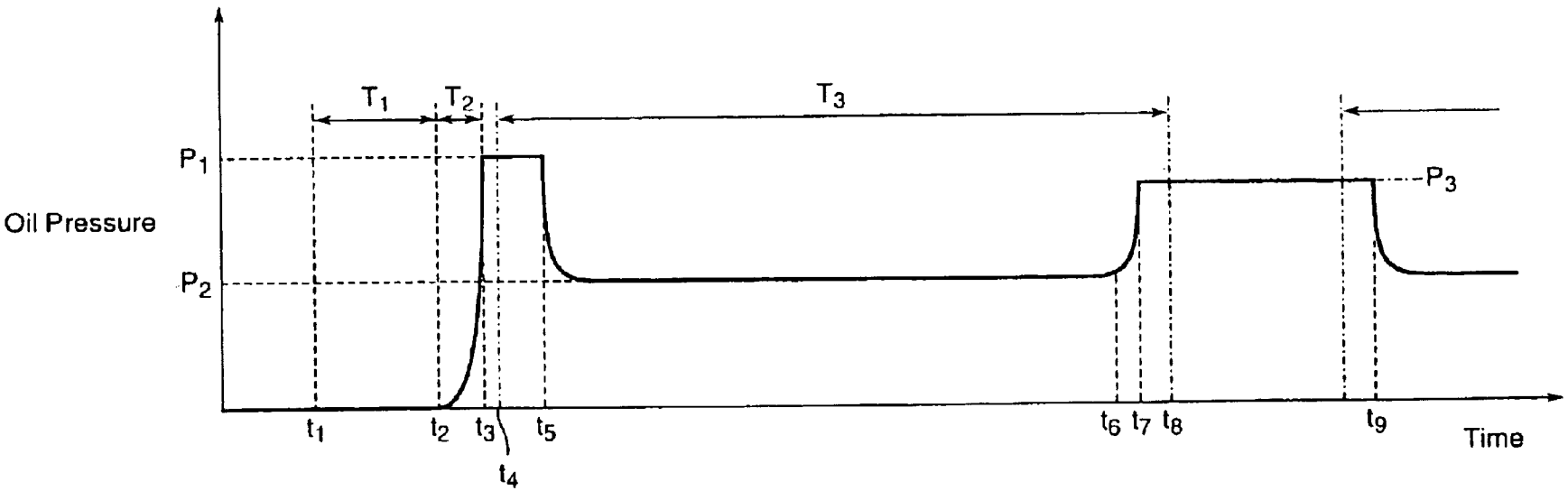
FIG. 6 is a time chart showing the working oil pressure of hydraulic cylinders in a method for operating a rolling mill according to a third embodiment of the present invention.

That is, as shown in FIGS. 3 and 6, the rolling of the rollable material S by the rolling mill 101 nears completion, and the end portion detection sensor 40 detects the rear end portion of the rollable material S. In this case, the control device 30 controls the hydraulic device 29 at a time $t_6$, thereby raising the working oil pressure of the hydraulic cylinders 21 to 28. At a time $t_7$, the working oil pressure of the hydraulic cylinders 21 to 28 reaches a high pressure value $P_3$. At a time $t_8$, the rear end portion of the rollable material S comes off from between the work rolls 14 and 15. At this time, the rear end portion of the rollable material S is reliably held under the working oil pressure $P_3$ of the hydraulic cylinders 21 to 28, so that the rollable material S is properly transported. The load cell 39 detects an increase in the reaction force against rolling, thus determining that after the rear end portion of the rollable material S has left the rolling mill 101, the front end portion of the next rollable material S is completely engaged between the work rolls 14 and 15. At a time $t_9$, the control device 30 controls the hydraulic device 29 to lower the working oil pressure of the hydraulic cylinders 21 to 28 and maintain it at a predetermined low pressure value $P_2$.

In the rolling mill of the present embodiment and the method for its operation, as described above, since before release of the rear end portion of the rollable material S from the work rolls 14 and 15 until the completion of engagement of the next rollable material S between the work rolls 14 and 15, the working oil pressure of the hydraulic cylinders 21 to 28 is set at the high pressure value $P_3$, whereby the pressing force on the roll chocks 12, 13, 16, 17 is rendered high. Thus, the frequent operational control of the hydraulic device 29 and the hydraulic cylinders 21 to 28 by the control device 30 becomes unnecessary, and the durability of the control device 30, hydraulic device 29 and hydraulic cylinders 21 to 28 can be increased. Also, the impact force occurring when the front end portion of the rollable material S is engaged between the work rolls 14 and 15 can be abated. Moreover, buckling or bending or a snaking motion caused when the rear end portion of the rollable material S departs from the work rolls 14 and 15 can be suppressed, and the accuracy of the plate thickness can be increased.

In finish rolling equipment, a rollable material S is generally rolled to a plate thickness with predetermined accuracy by imposing a screw down force in the thickness direction, with tension in the longitudinal direction being exerted by the preceding and succeeding rolling mills. However, sufficient tension cannot be applied to the front end portion and rear end portion of the rollable material S. Thus, these portions cannot secure a high accuracy plate thickness, and are handled as scrap. In the present embodiment, when the front end portion of a rollable material S, which will generally be reduced to scrap, is engaged between the work rolls 14 and 15, or when the rear end portion of the rollable material S, which will generally be reduced to scrap, is released from the work rolls 14 and 15, the working oil pressure of the hydraulic cylinders 21 to 28 is increased to abate the impact force acting on the work rolls 14, 15 and backup rolls 18, 19. Hence, the area of the rollable material S, which will be a product, is not damaged, and shock when the rollable material S is engaged between and released from between the work rolls 14 and 15 can be suppressed reliably. Consequently, the accuracy of the plate thickness can be increased.

In the above-described embodiments, the hydraulic cylinders 21 to 28 are disposed for the work rolls 14, 15 and backup rolls 18, 19 as the rolling rolls. However, hydraulic cylinders may be disposed for the work rolls 14, 15 alone, or hydraulic cylinders may be disposed only for the backup rolls 18, 19. Furthermore, the hydraulic cylinders 21 to 28 are disposed on the entry side and the delivery side of the housing 11, but hydraulic cylinders may be disposed on one of the entry side and the delivery side.

In the respective embodiments, the pressing means are only the hydraulic cylinders 21 to 28. However, contraction portions may be provided in hydraulic supply and discharge pipes connecting hydraulic pumps of the hydraulic device 29 and the hydraulic cylinders 21 to 28. During rolling, the roll chocks 12, 13, 16, 17 may be pressed against the housing 11 by the hydraulic cylinders 21 to 28 under these conditions. As a result, the gaps between the roll chocks 12, 13, 16, 17 and the housing 11 can be eliminated to increase the horizontal dynamic stiffness. Consequently, mill vibrations can be suppressed to achieve high efficiency rolling.

Besides, the rolling mill of the present invention, and the method for operating it are preferably used not only for ordinary conventional rolling mills, but also for cross rolling mills and shift rolling mills.

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. A rolling mill, comprising:

a housing;

upper and lower rolling rolls rotatably supported by the housing via roll chocks;

screw down means provided in an upper portion of the housing and adapted to apply a predetermined pressure to the rolling roll;

pressing means for thrusting the roll chocks along a transport direction of a rollable material to press the roll chocks against the housing;

end portion detecting means for detecting an end portion of the rollable material which is traveling;

rolling force detecting means for detecting a rolling force by the rolling rolls; and control means which, based on results of detection by the end portion detecting means, sets a thrusting force by the pressing means at a first value prior to engagement of the rollable material between the rolling rolls, maintains the first value, and, upon detection of the engagement by the rolling force detecting means, sets the thrusting force at a second value, lower than the first value, wherein based on the results of detection by the end portion detecting means, the control means sets the thrusting force at a third value, higher than the second value, before passage of a rear end of the rollable material between the rolling rolls.

2. The rolling mill of claim 1, wherein based on the results of detection by the rolling force detecting means, the control means sets the thrusting force at a fourth value, lower than the second value, after passage of the rear end of the rollable material between the rolling rolls.

3. A method for operating a rolling mill that includes a housing, upper and lower rolling rolls rotatably supported by the housing via roll chocks, screw down means provided in an upper portion of the housing for applying a predetermined pressure to the rolling roll, and pressing means for thrusting the roll chocks along a transport direction of a rollable material to press the roll chocks against the housing, the method comprising:

setting a thrusting force by the pressing means at a first value prior to engagement of the rollable material between the rolling rolls;

maintaining the first value and initiating rolling of the rollable material under the first value for a first period of time;

setting the thrusting force at a second value, lower than the first value, and rolling the rollable material under the second value after the first period of time;

applying the thrusting force along a transport direction of the rollable material; and setting the thrusting force at a third value, higher than the second value, before passage of a rear end of the rollable material between the rolling rolls.

4. The method of claim 3, further comprising:

setting the thrusting force at a fourth value, lower than the second value, after passage of the rear end of the rollable material between the rolling rolls.

5. The method of claim 4, wherein the third value is lower than the first value.

6. The method of claim 3, further comprising:

maintaining the third value until completion of engagement of a next rollable material between the rolling rolls.

* * * * *